United States Patent [19]

Miyakawa

[11] 4,034,722

[45] July 12, 1977

[54] DIGITAL CONTROL FUEL INJECTION APPARATUS

[75] Inventor: Nobuaki Miyakawa, Hitachi, Japan

[73] Assignee: Hitachi, Ltd., Japan

[21] Appl. No.: 656,596

[22] Filed: Feb. 9, 1976

[30] Foreign Application Priority Data

Feb. 7, 1975 Japan ..... 50-15400

[51] Int. Cl.[2] ..... F02B 3/00

[52] U.S. Cl. ..... 123/32 EB; 123/32 ED

[58] Field of Search ..... 123/148 E, 32 EA, 32 EB, 123/32 ED

[56] References Cited

U.S. PATENT DOCUMENTS

| | | | |
|---|---|---|---|
| 3,689,753 | 9/1972 | Williams et al. | 123/32 EB |
| 3,796,197 | 3/1974 | Locher et al. | 123/32 EA |
| 3,835,819 | 9/1974 | Anderson | 123/32 EB |
| 3,854,458 | 12/1974 | Reddy | 123/32 EA |
| 3,964,443 | 6/1976 | Hartford | 123/32 EB |

*Primary Examiner*—Samuel Feinberg

*Attorney, Agent, or Firm*—Craig & Antonelli

[57] ABSTRACT

A system for supplying fuel to an internal combustion engine, the fuel supply being dependent on the driving condition of the engine, comprises two types of detectors for detecting engine driving conditions and a memory for generating a signal representative of the fuel injection quantity in response to the engine driving conditions. A time-control circuit generates a pulse having a time duration determined by the output from the memory and a fuel injector injects fuel into the engine in accordance with the pulse of the time-control circuit. The memory comprises two stages, the first stage being a group of logical product circuits the number of which is dependent upon the number of different kinds of values defined as a function by two kinds of data of the engine driving conditions and the second stage being a group of logical summing circuits the number of which is the number of digital bits transmitted to the time-control circuit, in order to simplify the structure of the memory and to economize manufacture.

6 Claims, 7 Drawing Figures

DIGITAL CONTROL FUEL INJECTION APPARATUS

BACKGROUND OF THE INVENTION

The present invention relates to an electronic fuel injection apparatus and especially a digital control fuel injection apparatus in which the opening time duration of a fuel injection valve is dependent upon a stored data output from a memory in response to an engine driving condition.

In an internal combustion engine, for reducing the pollution of exhaust gases from the engine and for improving the efficiency of the engine operation, it is necessary to precisely adjust the fuel quantity supplied to the engine. The fuel quantity may be determined as a function of two parameters, such as engine speed and throttle opening or intake suction, representing an engine driving condition, and is continuously changed by continuously changing these two parameters. Namely, the fuel injection quantity may be represented by mathematical surface produced by these two parameters. It is impossible to store such a mathematical surface. Therefore, these parameters are respectively divided into a large number of segments, in a rectangular coordinate system and each small surface defined by one segment of a first parameter X and one segment of a second parameter Y has only one value along the Z axis.

In a conventional system, if the first parameter X is an m bit, digital signal and the second parameter Y is a 1 bit digital signal, the number of memorized addresses is $2^{(m+1)}$. Namely, each memorized address corresponds to each small surface, so that the number of memorized addresses becomes large. For reducing the number of addresses, the divisional numbers corresponding to the first and second parameters X and Y are decreased. However, the control accuracy for the fuel control system becomes significantly reduced, and an interpolation circuit is required for increasing the degree of control accuracy. Therefore, the apparatus is expensive to manufacture.

SUMMARY OF THE INVENTION

An object of the invention is to provide a fuel injection apparatus provided with a simple memory for memorizing the fuel quantity in response to each divisional segment representative of X and Y parameters.

Another object of the invention is to provide a fuel injection apparatus provided with a low cost memory.

In accordance with the present invention two kinds of parameters (X and Y) representing an engine driving condition are detected as digital signals by two types of detectors, for example, an engine speed detector and a throttle opening (or intake suction) detector. A memory supplies digital data representative of the quantity of fuel suitable for the engine in accordance with the X and Y parameters. A fuel injector is operated in response to the digital data, so as to inject the fuel into the engine during a time duration determined by the digital data from the memory. The memory of the present invention comprises two stages, a first stage being a group of logical product circuits such as an AND gate or a NAND gate, the number of which is dependent on the number of different kinds of values of small surfaces defined by the segments of the two kinds of parameters X and Y of the engine driving condition, and a second stage being a group of logical summing circuits such as an OR gate or a NOR gate, the number of which corresponds to the number of digital bits required by the fuel injector.

DETAILED DESCRIPTION

Figure 1:
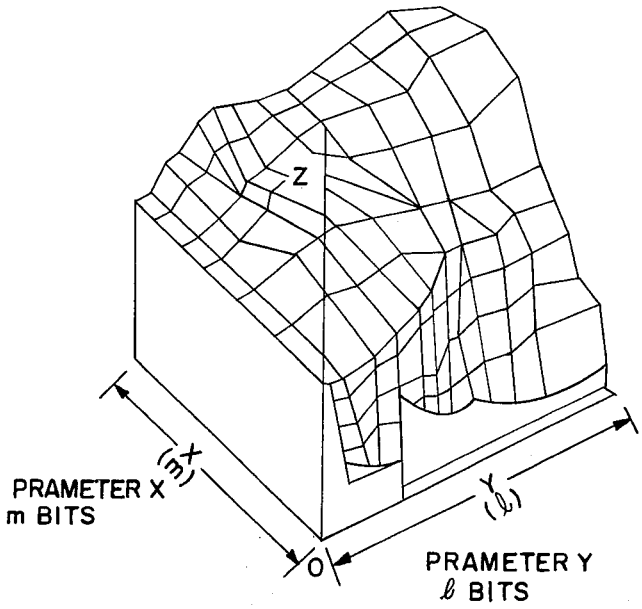
FIG. 1 depicts a mathematical surface representative of the fuel supply to the engine.

Referring to FIG. 1, fuel injection quantity or fuel injection time is mathematically depicted as a function of two kinds of parameters X and Y representing an engine driving condition. The Z axis representing the fuel injection quantity continuously depends upon the two parameters. The fuel injection quantity of each engine driving condition has been previously stored and a fuel injector injects fuel for a limited time corresponding to the memorized value. Since it is impossible to memorize the continuously curved mathematical surface itself, the parameters X and Y are divided into a large number of segments and a small surface defined by each of the X and Y segments has only one Z value. The memory memorizes every Z value for each small segmented surface. The number of the divided segments of the parameters X and Y is determined by accuracy needed for fuel injection.

In a vehicle engine, it is often the case that many of the small surfaces defined by the segments of the parameters X and Y have the same Z value, so that the number of different Z values is not large. If the small surfaces which have same Z value are summed up, the number of small surfaces to be stored becomes very small.

Figure 2:
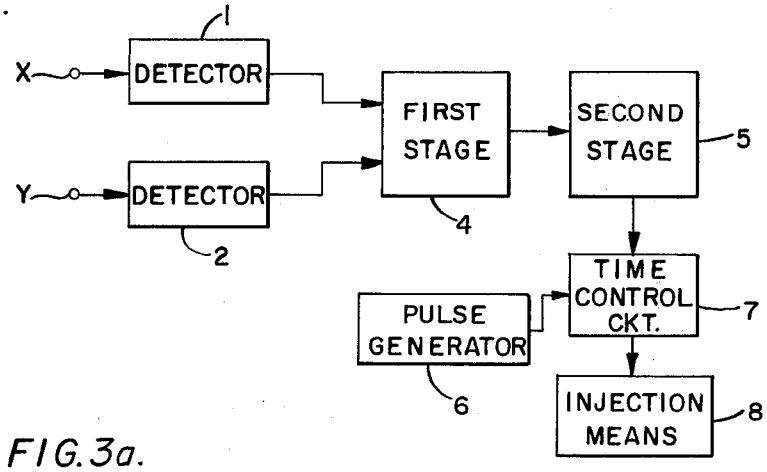
FIG. 2 is a block diagram of a fuel injection apparatus according to the present invention.

Referring to FIG. 2, two detectors 1 and 2 detect two kinds of parameters X and Y representing engine driving conditions and convert them into digital signals. These digital signals are applied to a first stage 4 of a memory which comprises a group of logical product circuits such as AND gates and NAND gates the output of which first stage is connected to a second stage 5 of the memory. The second stage 5 comprises a group of logical summing circuits the output of which second stage is connected to a time control circuit 7 for producing time duration pulses for controlling the fuel injection duration caused by a fuel injector 8. Numeral 6 represents a pulse generator for producing pulses having a changeable frequency.

The first and second stages 4 and 5 of the memory store fuel injection quantities each of which corresponds to a Z value for a small surface shown in FIG. 1.

Figure 3A:
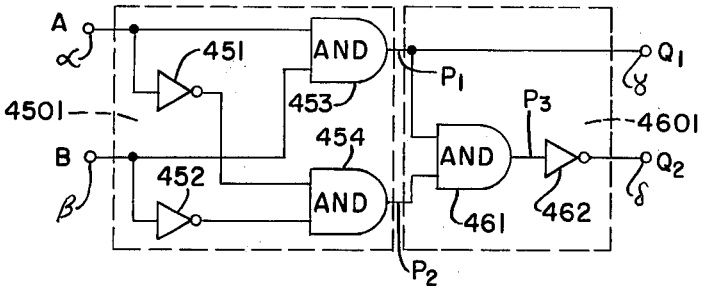
FIGS. 3(*a*) and 3(*b*) are simple schematic circuit diagrams for explaining the principles of the memory of the invention.
Figure 3B:
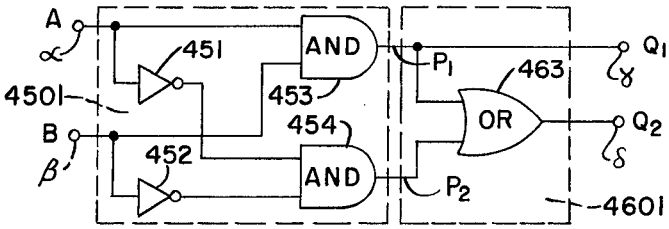

A most simplified circuit for the memory is shown in FIGS. 3(*a*) and 3(*b*) in which a circuit 4,501 corresponds to the first stage circuit 4 of FIG. 2 and a circuit 4,601 corresponds to the second stage circuit 5. The two input terminals a and b receive two kinds of input parameter signals A and B, respectively, which are fed to an AND gate 453 and an AND gate 454 through an invertor 451 or 452. The output terminal $P_1$ of the AND gate 453 is connected to a terminal $\gamma$ which supplies a signal $Q_1$. An AND gate 461 receives the outputs of the AND gates 453 and 454 and delivers the output to a terminal $\delta$ through an invertor 462 from the output terminal $P_3$.

The output signals $P_1$ and $P_2$ from the AND gates 453 and 454 are defined as $$\left.\begin{aligned} P_1 &= A \cdot B \\ P_2 &= \bar{A} \cdot \bar{B}. \end{aligned}\right\} \quad (1)$$

The output signals $Q_1$ from the terminal $\gamma$ and $P_3$ from the AND gate 461 are defined as $$\left.\begin{aligned} Q_1 &= P_1 = A \cdot B \\ P_3 &= P_1 \cdot P_2 = (A \cdot B) \cdot (\bar{A} \cdot \bar{B}) \end{aligned}\right\} \quad (2)$$

Therefore, the output $Q_2$ of the terminal $\delta$ is $$Q_2 = \overline{(A \cdot B) \cdot (A \cdot B)} = (A \cdot B) + (\bar{A} \cdot \bar{B}) = P_1 + P_2 \quad (3)$$

As a result of the equations (2) and (3), the output $Q_2$ is the logical sum of the output $P_1$ of the AND gate 453 and the output $P_2$ of the AND gate 454, and it is possible to replace the circuit of the AND gate 461 and the inverter 462 by an OR circuit 462 as shown in FIG. 3(*b*).

An output produced by the combination of the inputs A and B can be produced by a group of logical product circuits 4501 and a group of logical sum circuits 4601.

Figure 4:
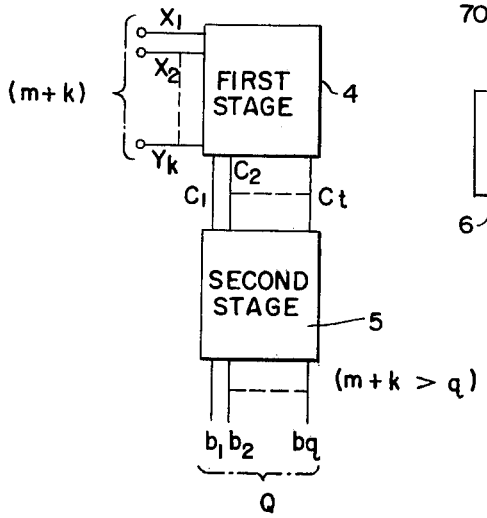
FIG. 4 is a block diagram of a memory of the present invention.

Referring to FIG. 4, input parameters $X_1, \ldots X_m, Y_1 \ldots Y_k$ are applied to a first stage 4 of the memory which is a group of logical product circuits. The output data $C_1, C_2, \ldots C_t$ from the first stage 4 are $$\left.\begin{aligned} C_1 &= X_1 \cdot X_2 \cdots X_f \cdot Y_1 \cdots Y_i \\ C_2 &= X_1 \cdot X_2 \cdots X_l \cdot Y_1 \cdots Y_j \\ C_t &= X_1 \cdot X_2 \cdots X_m \cdot Y_1, Y_2 \cdots Y_k \end{aligned}\right\} \quad (4)$$

$$f < m,\ l < m,\ i < k,\ j < k$$

These output data $C_1 - C_t$ from the first stage 4 are applied to the second stage 5 and the output data $b_1$–$b_q$ are obtained from the second stage 5 as $$\left.\begin{aligned} b_1 &= C_1 + C_2 + \cdots + C_p \\ b_2 &= C_1 + C_2 + \cdots + C_r \\ b_q &= C_1 + C_2 + \cdots + C_t \end{aligned}\right\} \quad (5)$$

$$p < t$$

$$r < t$$

Each of the output data $C_1 - C_t$ is produced by each logical product circuit so hat some data selected from the input parameters $X_1$–$X_m$ $Y_1$–$Y_k$ representing the relationships between the input parameters X and Y and each Z value of the small surfaces are applied to a certain logical product circuit. Each of the output data $b_1 - b_q$ is also produced by each logical summing circuit so that some data selected from the output data $C_1$–$C_t$ of the logical product circuits representing the relationships between the input parameters and each Z value of the small surface are applied to a certain logical summing circuit.

Figure 5:
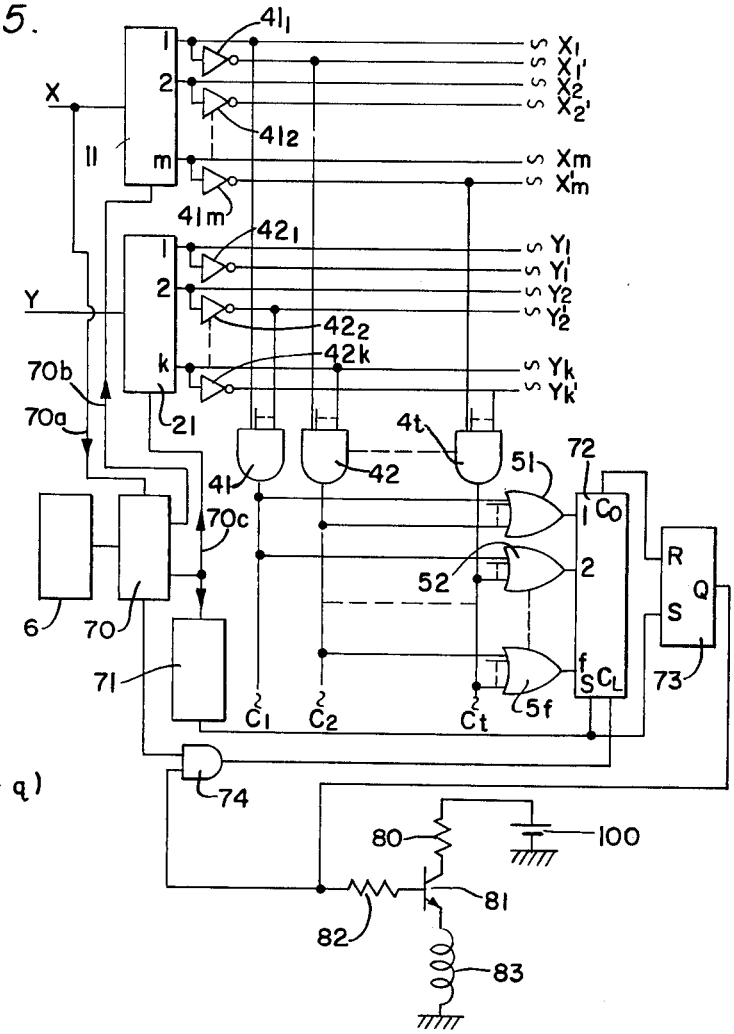
FIG. 5 is a detailed description of the present invention.

Referring to FIG. 5, a digital converter 11 receives the engine driving parameter X, which is a pulse having a time duration or a frequency representing the engine speed and generates a first digital signal having m bits. A second digital converter 21 receives the engine driving parameter representing the pressure change in the intake manifold and delivers a second digital signal having k bits. Invertors 411 41*m* invert every digital bit $X_1$–$X_m$ of the first digital signal and generates signals $X_1'$–$X_m'$. Invertors 421–42*k* also invert every digital bit $Y_1$–$Y_m$ of the second digital signal and generate signals $Y_1'$–$Y_k'$. The number of output bits $X_1$–$X_m$ $X_1'$–$X_m'$ from the first digital converter and the invertors is twice as large as the number of bits from the first digital converter and the number of the output bits $Y_1$–$Y_k Y_1'$–$Y_k'$ is also twice as large as the number of bits from the second digital converter.

AND gates 41–4*t* recieve the output signals in accordance with equation 4 and each of the AND gates 41–4*t* generate output data $C_1$–$C_t$ as shown in equation 4, respective. OR gates 51–5*q* receive the output data $C_1$–$C_t$ in accordance with equation 5. The output of each OR gate is in response to each bit representative of the input digital signal of a preset counter of the time control circuit. The number of bits of the input digital signal of the preset counter is determined by the accuracy of the fuel injection control.

Numeral 6 is a pulse generator for generating pulses having a frequency in accordance with engine temperature and atmospheric pressure. Numeral 70 is a control circuit which transmits the pulse from the pulse generator 6 to the preset counter 72 through an AND gate 74 and transmits pulses 70*b* and 70*c* in response to an engine rotation signal 7*a* (crank angle) for the parameter X for supplying new condition data into the first and second converters. Numeral 71 is a delay circuit which delays the pulse 70C by a certain period required for operating the first and second convertors 11 and 21, the AND gates 41–4*t* and the OR gates 51–5*q*. When the delayed pulse is applied from the delay circuit 71 is a set terminal s of the preset counter 72, the output signals of the OR gate 51–5*q* having q bits are set into the preset counter. At the same time, a flip flop 73 is set and the AND gate 74 is opened by the output of the flip flop 73. The flip flop 73 also supplies its output to the base of a transistor 81 and the transistor is turned on so that current flows into a magnetic coil 83 of a fuel injection valve (not shown) from a battery 100 through the resistor 81. Therefore, the fuel injection valve is opened for injecting fuel into the engine and the pulses from the control circuit 70 are applied to the clock terminal of the preset counter 72.

Figure 6:
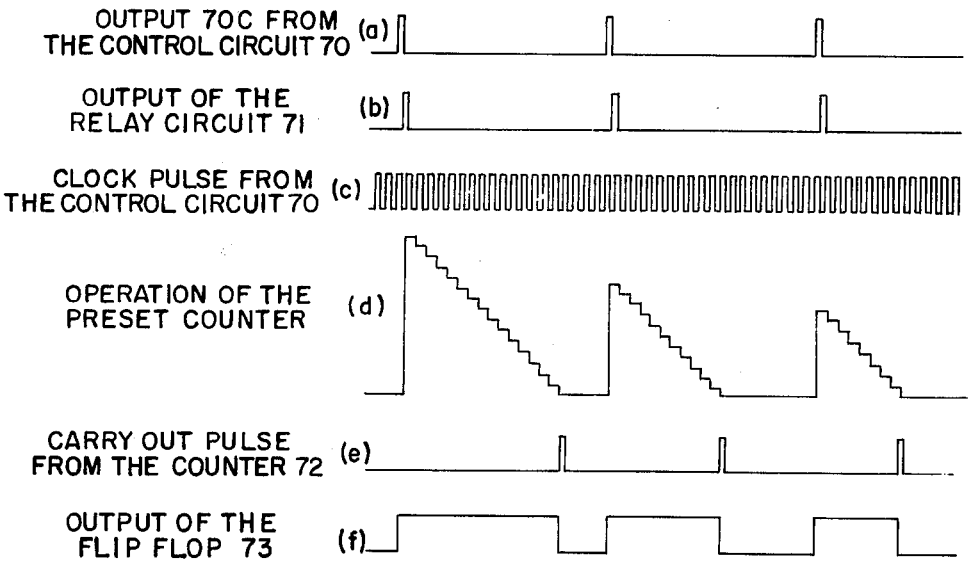
FIGS. 6(*a*) –6(*f*) depict voltage waveforms of various signals of the circuit of FIG. 5.

Referring to FIGS. 6 (*a*) – 6 (*f*) the output pulse 70C from the control circuit 70 is shown in FIG. 6 (*a*) and the output of the delay circuit 71 is shown in FIG. 6 (*b*) by which the preset counter receives the output of the group of OR gates 51-5q. At the same time the flip-flop 73 generates a pulse for controlling the fuel injection valve and the AND gate 74. The pulses shown in FIG. 6 (c) are applied to the clock terminal of the preset counter 72 through the AND gate 74 and the preset counter setting the output from the OR gate group representing a suitable fuel injection quantity is down-counted by these pulses to a predetermined count such as a zero count, as shown in FIG. 6 (*d*). When the preset counter 72 reaches the predetermined count such as the zero count, carry out pulses as shown in FIG. 6 (*e*) are applied to the reset terminal R of the flip flop 73, where upon the output pulse from the flip-flop 73 is terminated and AND gate 74 and the fuel injection valve are closed. The pulse duration from the flip-flop 73 as shown in FIG. 6 (*f*) is the fuel injection period or the injecting fuel quantity.

Since the memory of the present invention is separated into two stages, the first stage being a group of AND gates and the second stage being a group of OR gates, there are the following advantages. In the conventional fuel injection apparatus, the number of memory addresses is the same as the number of small surfaces defined by the divided parameters X and Y. It is necessary to provide $2^{(m+k)}$ types of addresses, where $(m+k)$ is the bit number of the parameters X and Y. In accordance with the present invention it is possible to decrease the number of parts comprising the memory by suitably selecting the memory addresses in accordance with the relationships between the kinds of Z axis value of the small surface and the engine driving parameters. If the many small surfaces have the Z value, these small surfaces can be summed and only one small surface serves for all these small surfaces. Therefore, it is possible to simplify the memory. In the above embodiment, the injected fuel quantity is determined by two kinds of engine parameters X and Y. Where the fuel quantity is dependent on more than two kinds of the engine parameters X and Y, the present invention is available for use with such parameters.

I claim:

1. A fuel injection apparatus for controlling the injection of fuel in an internal combustion engine wherein the quantity of injected fuel is determined in accordance with the value of a function $Z=f(X, Y)$ where $X$ and $Y$ represent first and second respective engine condition parameters, comprising first means for generating an m bit first digital detection signal representative of said first engine condition parameter;

second means for generating an h bit second digital detection signal representative of said second engine condition parameter;

a first memory stage made up of a plurality of logic circuits corresponding to the value of the function Z for segmented divisions of the parameters X and Y;

third means, coupled between said first means and said first memory stage, for supplying a selected bit from said first digital detection signal to selected logical circuits of said first memory stage in accordance with the value of said function $Z=f(X, Y)$;

fourth means, coupled between said second means and said first memory stage, for supplying a selected bit from said second digital detection signal to selected logical circuits of said first memory stage in accordance with the value of said function $Z=f(X, Y)$;

a second memory stage made up of a plurality of logic circuits;

fifth means, coupled between said first memory stage and said second memory stage, for applying selected outputs of the logic circuits of said first memory stage to selected logic circuits of said second memory stage;

sixth means, coupled to said first and second means and said second memory stage, for generating a fuel injection duration pulse representative of the quantity of fuel to be injected by a fuel injection valve, in accordance with said first and second digital detection signals as controlled by the output of said second memory stage; and a fuel injection valve, coupled to said sixth means, for injecting fuel into the engine in accordance with said fuel injection duration pulse.

2. A fuel injection apparatus according to claim 1, wherein the logic circuits making up said first memory stage are logical product circuits and the logic circuits making up said second memory stage are logical summing circuits.

3. A fuel injection apparatus according to claim 2, wherein said sixth means comprises a pulse generator, a counter, coupled to said pulse generator and said second memory stage, and a flip-flop circuit coupled to said counter, said flip-flop being placed in a first binary state upon receipt of a first pulse from said generator and remaining in said first binary state until the value of the counter of said counter corresponds to a prescribed digital value as determined by the contents of said second memory stage, the duration of said fuel injection duration pulse corresponding to the length of time that said flip-flop is in said first binary state.

4. A fuel injection apparatus according to claim 3, wherein said pulse generator produces pulses at frequency in accordance with engine temperature and atmospheric pressure.

5. A fuel injection apparatus according to claim 3, wherein said sixth means further comprises a delay circuit, coupled between said pulse generator and said counter and flip-flop circuit for delaying the application of said pulses thereto a period of time sufficient to permit the storage of digital data in said second memory stage, in accordance with said first and second engine condition parameters X and Y, for presetting the duration of sid fuel injection duration pulse.

6. A fuel injection apparatus according to claim 5, wherein said pulse generator produces pulses at frequency in accordance with engine temperature and atmospheric pressure.

* * * * *